United States Patent [19]

Smith

[11] 4,363,256

[45] Dec. 14, 1982

[54] EASY FRET

[76] Inventor: Robert L. Smith, 1037 East Beddell St., Ft. Worth, Tex. 76115

[21] Appl. No.: 127,588

[22] Filed: Mar. 6, 1980

Related U.S. Application Data

[63] Continuation-in-part of Ser. No. 960,955, Nov. 15, 1978, abandoned.

[51] Int. Cl.[3] ..... G10D 3/08
[52] U.S. Cl. ..... 84/317
[58] Field of Search ..... 84/315–318

[56] References Cited

U.S. PATENT DOCUMENTS

| | | | |
|---|---|---|---|
| 1,219,884 | 3/1917 | Thingstad | 84/317 |
| 2,117,628 | 5/1938 | Richman | 84/315 |
| 2,746,337 | 5/1956 | Smit | 84/315 X |
| 3,129,626 | 4/1964 | Granius | 84/317 |
| 3,805,664 | 4/1974 | Starns | 84/317 |
| 3,915,051 | 10/1975 | Kincaid | 84/317 |
| 3,995,523 | 12/1976 | Clarke | 84/317 |
| 4,030,400 | 6/1977 | Del Castillo | 84/317 |

*Primary Examiner*—Lawrence R. Franklin

[57] ABSTRACT

A manual, mechanical chord or note selecting device mounted on a fretted, stringed, musical instrument, said device having a convenient leverage means for faster, easier keying.

4 Claims, 9 Drawing Figures

EASY FRET

This application is a continuation-in-part of a prior application of Robert L. Smith, Ser. No. 960,955, filed Nov. 15, 1978, now abandoned.

This invention relates to the fretting of stringed, musical instruments such as six or twelve stringed guitars, ukuleles, mandolins, banjos, and the like, and more particularly to the manual, mechanical means of fretting of said fretted, stringed, musical instruments.

Easy Fret is a fretting means for fretted, stringed, musical instruments, but it has special application to six or twelve stringed guitars to which reference is made in the accompanying drawings and description. However, the said Easy Fret is not limited thereto.

The prior art for this invention includes a disadvantage of having at least three springs and three rods for the making of each chord, the number of springs and rods being controlled by the number of notes in the chord. The greater the number of notes in the chord, the greater the number of springs and rods, and the greater the tension of the springs and the friction of the rods that is encountered by the musician as the fretting means is operated. The guitar without the fretting means requires a certain amount of force applied by the fingers upon the strings of the said guitar. To this customary unit of force add the force to overcome the tension of the springs and the friction of the rods which is developed during the operation of the said fretting means. The more springs and rods, the more extra force is needed to make the said chords, the more rapidly the fingers of the musician will get tired, and thus more work is necessary to sustain the conditioning of the fingers for prolonged operation of the said fretting means.

The advantage of the present invention is obtained by offering two solutions to this tension and friction problem. The invention herein specified solves this problem of having much tension and friction generated by many moving parts by eliminating moving parts within the art and by creating a leverage means which overpowers any remaining tension and friction. Therefore, endurance is not a requirement for operating the invention set forth in this specification.

The prior art for this invention also has a disadvantage that the keys for playing melodies are located in positions that are difficult to reach by the fingers of the musician in that they are placed in various measurements along the underside of the keyboard of the guitar. The ends of these said keys having a small area raised above the neck of the said guitar and having a difficult location causes the playing of these said keys to be almost impossible. Discovering the majors and the minors adds to this task of locating the correct keys quickly. The keys for the notes, the majors, and the minors are similar to each other on the keyboard of the prior art.

The leverage means of this present invention disposes of the operating difficulties of the fretting means of the prior art by moving the levers out to the front of the guitar and by allowing the levers of the notes to be arranged on a lower level than the levers of the majors and the minors. This separation of levers of a different classification into separate areas in space will remove confusion, and the moving of all of the levers out to the front of the said guitar will make them easier to reach, thus easier to play.

A main object of this invention is to develop a manual, mechanical means of fretting stringed musical instruments thereby decreasing the technical knowledge, skills, and experience necessary to become proficient in the mastery of these said musical instruments.

A further object of this invention is to develop a manual, mechanical means of fretting stringed, musical instruments thereby increasing the aesthetic, artistic pleasure of the casual instrumentalist who wants to pursue a hobby in music with a nominal investment in time and money.

A further object of this invention is to develop a fret-selecting means for fretted, stringed, musical instruments consisting of a manually, mechanically operated key-board that is so efficient and easy to operate that it can be operated by any musician, however young or physically undeveloped that musician may be.

A further object of this invention is to develop a fret-selecting means for fretted, stringed, musical instruments consisting of a manually, mechanically operated key-board that may be energized by the finger pressure of the musician applied to a leverage means, thus simplifying the operation of the said fret-selecting means.

Other objects and features of the invention will be readily apparent to those skilled in the art from the specification and appended drawings illustrating by example a construction of my invention, in which drawings.

DESCRIPTION

Figure 1:
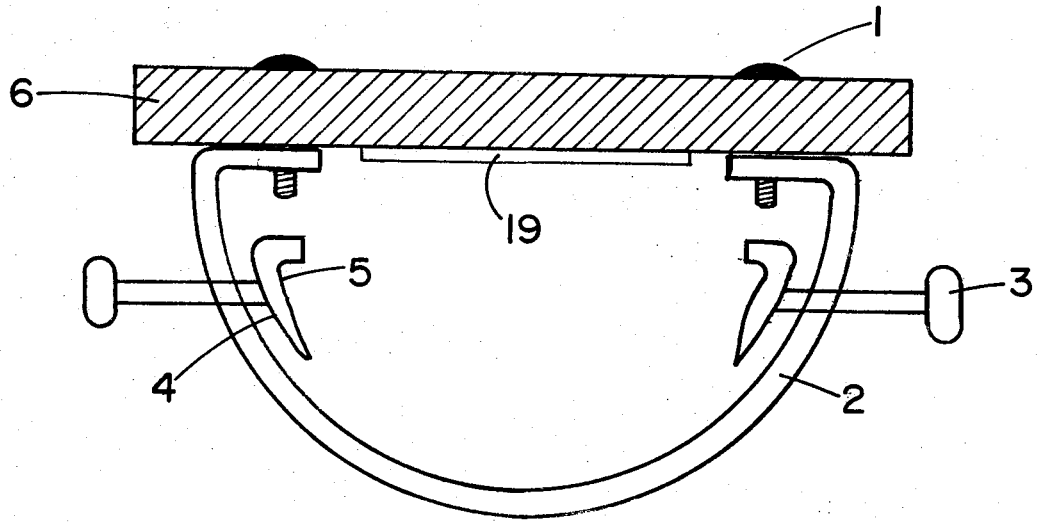
FIG. 1 is a cross sectional view of the means for securing Easy Fret to the neck of a guitar.

Referring to the drawings for description, FIG. 1 illustrates the means for securing Easy Fret to a six or twelve stringed guitar or any fretted, stringed, musical instrument, said means consisting of a screw (1) for fastening the brace (6) to the clamp (2), a brace (6) for holding the bolt (17), a clamp (2) for securing the brace (6) and for securing the winged nut (3), a winged nut (3) for holding the cleat (4) thus allowing the tension adjustments by the turning of the winged nut (3), a cleat (4) for holding the said guitar, a swivel (5) for making turning movements for tension adjustments, and a soft, pliable substance for noiseless operation (19).

Figure 2:
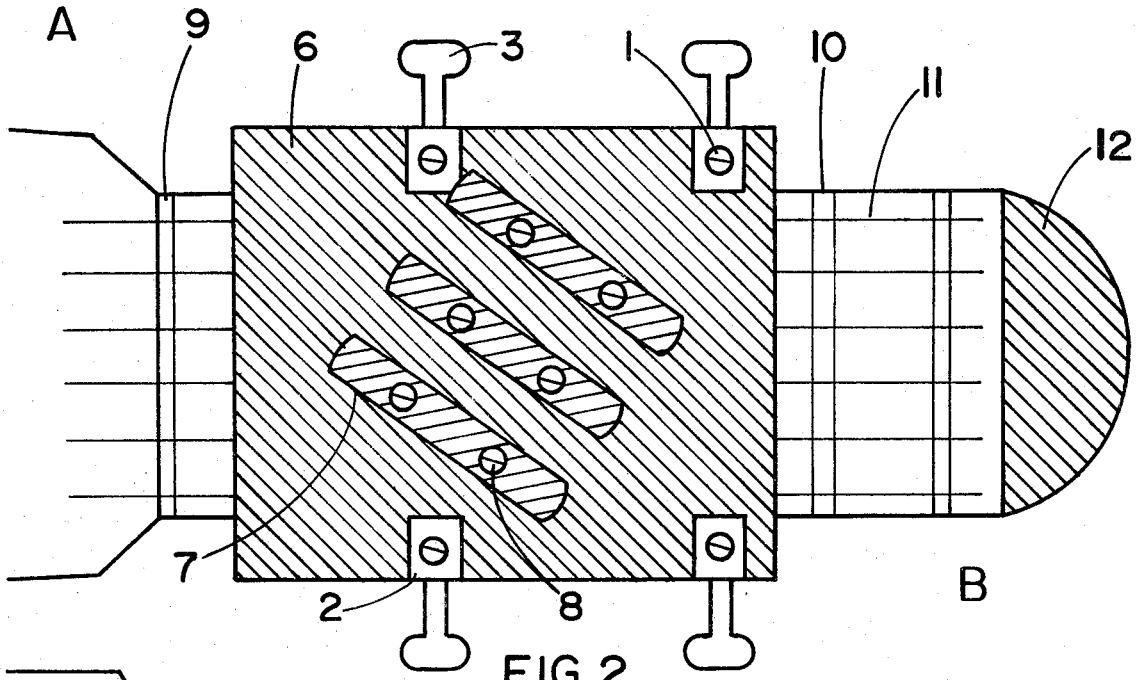
FIG. 2 is perspective view of a two bolt only design for the chord selecting means of East Fret.
Figure 3:
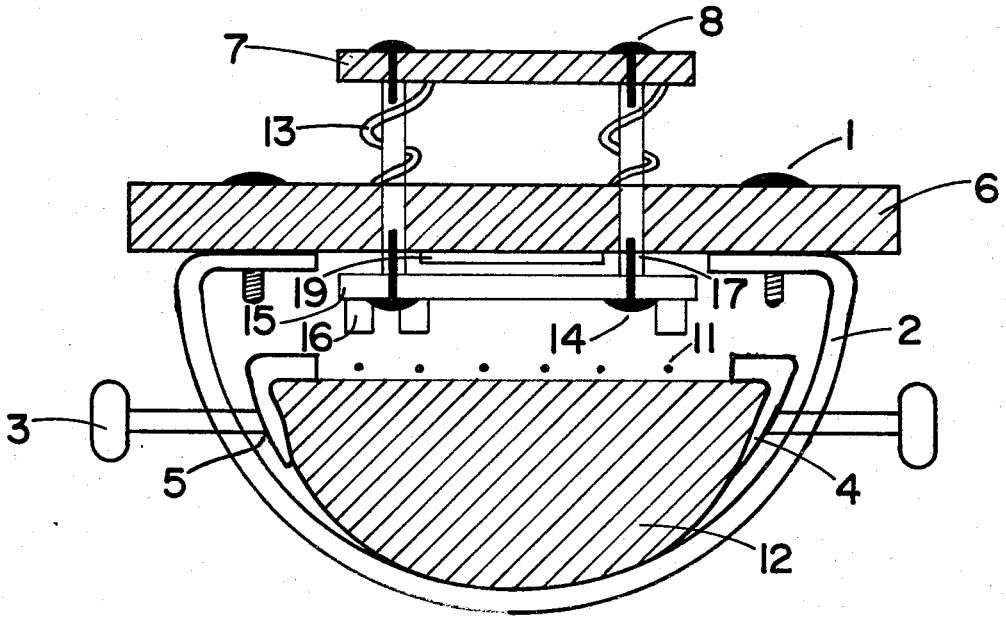
FIG. 3 is a vertical, diagonal, cross sectional view of a two bolt only design for the chord selecting means of Easy Fret along a line from A to B of FIG. 2.

FIG. 2 illustrates a perspective view of the chord selecting means for a six or twelve stringed guitar or any fretted, stringed, musical instrument, said chord selecting means consisting of a screw (1) for fastening the brace (6) to the clamp (2), a brace (6) for holding a set of two bolts only (FIG. 3;17), a clamp (2) for securing the brace (6) and securing the winged nut (3), a winged nut (3) for holding the cleat (FIG. 1;4) thus allowing tension adjustments by the turning of the winged nut (3), a pressure panel (7) for pressing the chord selecting means upon the strings (11) behind the frets (10) of the said guitar, and a screw (8) for fastening the said finger panel (7) to the said set of two bolts only (FIG. 3;17).

FIG. 3 is a vertical, diagonal, cross sectional view of a chord selecting means for a six or twelve stringed guitar or any fretted, stringed, musical instrument, said chord selecting means consisting of a screw (1) for fastening the brace (6) to the clamp (2), a brace (6) for holding a set of two bolts only (17), a clamp (2) for securing the brace (6) and securing the winged nut (3), a winged nut (3) for holding the cleat (4) thus allowing tension adjustments by the turning of the winged nut (3), a cleat (4) for holding the said guitar, a swivel (5) for giving the turning movement for tension adjustments, a pressure panel (7) for pressing the chord selecting means upon the strings (11) behind the frets (10) of the said guitar (12), screws (8) for fastening said finger panel (7) to the set of two bolts only (17), a set of two bolts only (17) for holding the plate (15) with screw (14) and for holding said pressure panel (7) with screw (8), a plate (15) for securing plate extensions (16), a set of plate extensions (16) for the fretting of the strings (11) behind the said frets (FIG. 2;10), a set of two springs only (13) to prevent accidental dampening of the said strings (11) of the said guitar (12), screws (14) for securing said plate (15) to the said set of two bolts only (17), and a soft, pliable substance (19) for noiseless operation of the said chord selecting means.

Figure 4:
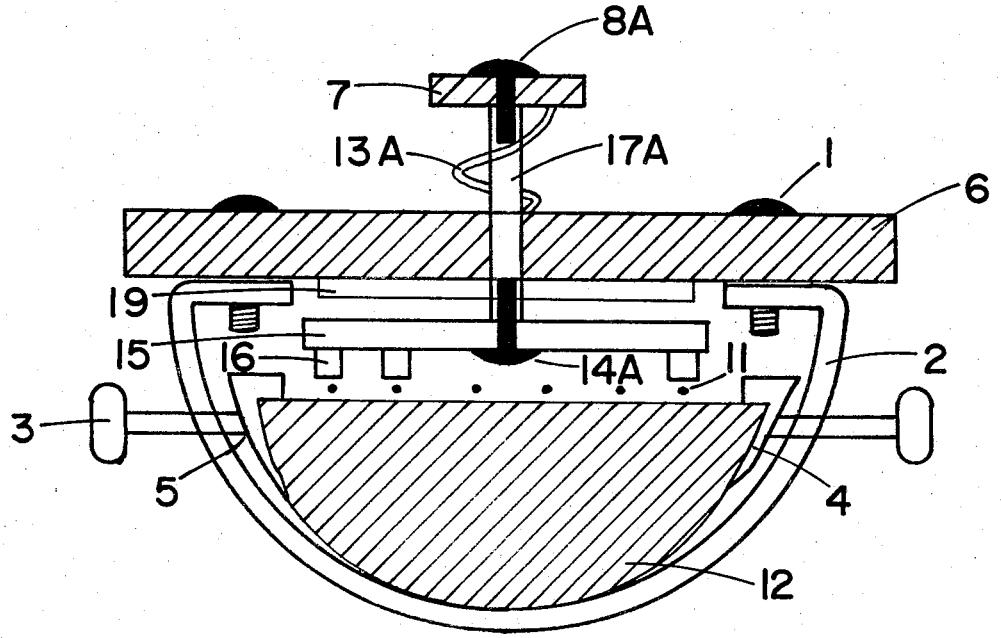
FIG. 4 is a vertical, diagonal, cross sectional view of a one square bolt only design for the chord selecting means of Easy Fret along a line from A to B of FIG. 2.

FIG. 4 is a vertical, diagonal, cross sectional view of a chord selecting means for a six or twelve stringed guitar or any fretted, stringed, musical instrument, said chord selecting means consisting of a screw (1) for fastening the brace (6) to the clamp (2), a brace (6) for holding one bolt (17*a*), a clamp (2) for securing the brace (6) and securing the winged nut (3), a winged nut (3) for holding the cleat (4) thus allowing tension adjustments by turning of the winged nut (3), a cleat (4) for holding the said guitar, a swivel (5) for giving the turning movement for tension adjustments, a pressure panel (7) for pressing the chord selecting means upon the strings (11) behind the frets (10) of the said guitar (12), screw (8*a*) for fastening said finger panel (7) to the square bolt (17*a*), square bolt (17*a*) for holding the plate (15) with screw (14*a*) and for holding said pressure panel (7) with screw (8*a*), a plate (15) for securing plate extensions (16), a set of plate extensions (16) for the fretting of the strings (11) behind the said frets (FIG. 2;10), a set of one spring (13*a*) to prevent accidental dampening the said strings (11) of the said guitar (12), a screw (14*a*) for securing said plate (15) to bolt (17*a*), and a soft, pliable substance (19) for noiseless operation of the said chord selecting means.

Figure 5:
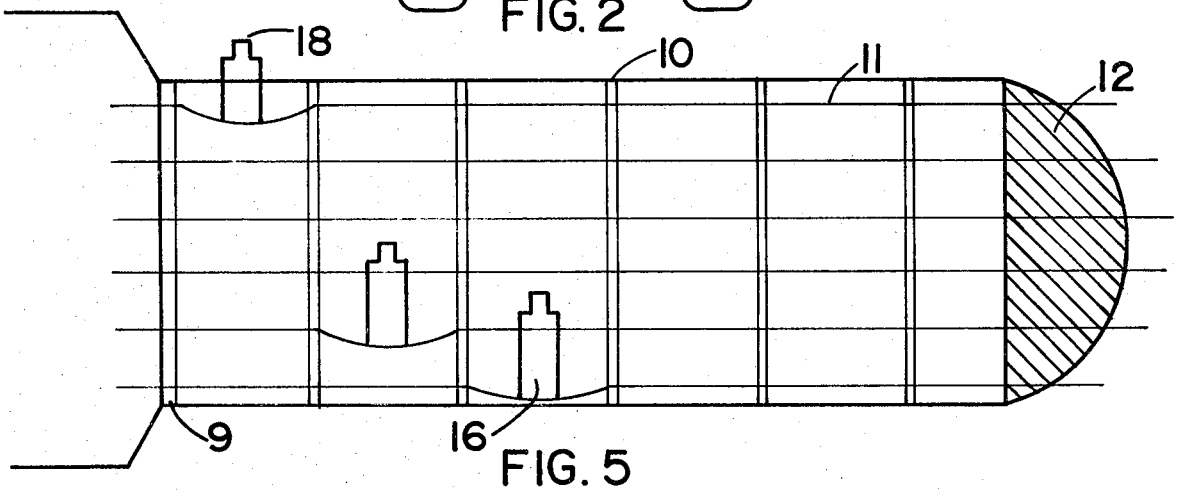
FIG. 5 is a perspective view of the plate extensions of the chord selecting means of Easy Fret as they are pressed upon the strings of a guitar forming a representative chord G7.

FIG. 5 is a partial perspective view of the plate extensions (16) being pressed upon the strings (11) of a guitar (12) illustrating chord G7, said strings (11) having been tuned to the tuning bolt (9) of the said guitar, said plate extensions (16) having a recessed means (18) for convenient attachment to the plate (FIG. 3;15).

Figure 6:
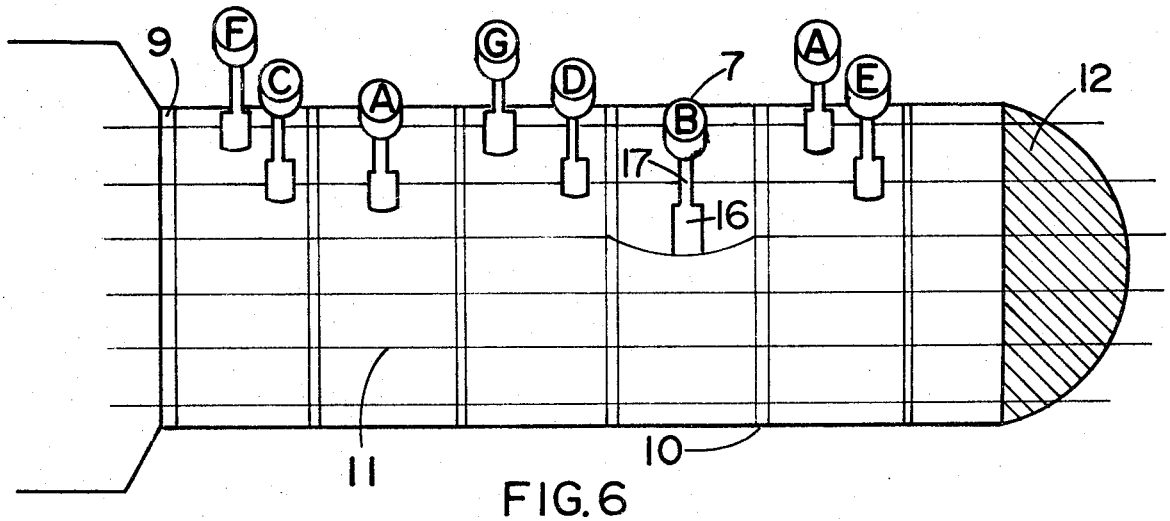
FIG. 6 is a fragmentary perspective view of the plate extensions of the note selecting means of Easy Fret with one said extensions illustrating the sounding of note B.

FIG. 6 is a partial perspective of a note selecting means for a six or twelve stringed guitar or any fretted, stringed, musical instrument, said note selecting means consisting of pressure panel (7) with scaled notation, a bolt (17) for connecting pressure panel (7) to extension (16), said pressure panel (7), bolt (17) and extension (16) illustrating note B.

Figure 7:
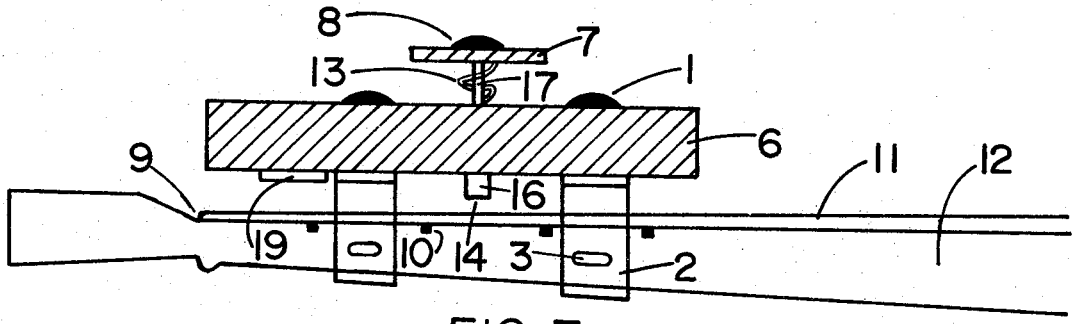
FIG. 7 is a lateral perspective view of the note selecting means of Easy Fret secured to a guitar.

FIG. 7 is a lateral, partial perspective view of a note selecting means for a six or twelve stringed guitar or any fretted, stringed musical instrument, said note selecting means consisting of a screw (1) for securing brace (6) to clamp (2), a clamp (2) for attaching brace (2) to the said guitar (12), a winged nut (3) for adjusting tension through a swivel (FIG. 1;5) and a cleat (FIG. 1;4) that holds the neck of the said guitar (12), a brace (6) for holding the bolt (17), a pressure panel (7) for pressing the note selecting means upon the strings (11) of the said guitar (12), a screw (8) for securing the pressure panel (7) to the bolt (17), a spring (13) for preventing accidental dampening of the strings (11) of the said guitar, a screw (14) for securing extension (16) to the bolt (17), an extension (16) for pressing the strings (11) behind the frets (10) of the said guitar (12), a bolt (17) for holding extension (16) with screw (14) and for holding pressure panel (7) with screw (8), and a soft, pliable substance (19) for noiseless operation of the said note selecting means.

Figure 8:
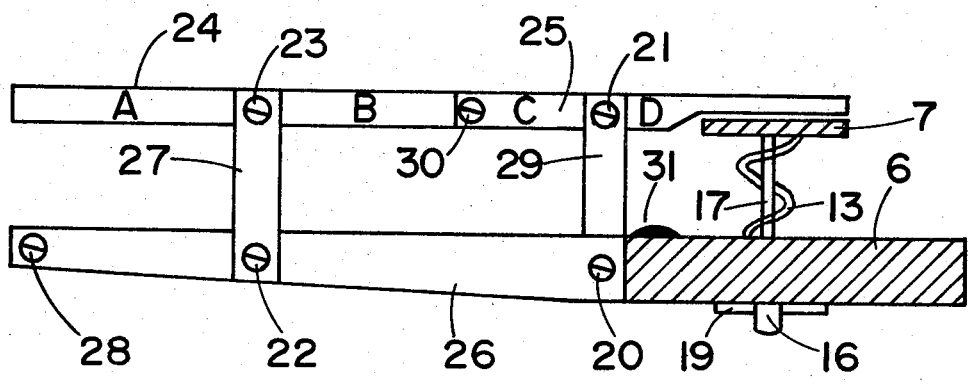
FIG. 8 is a lateral perspective view of a leverage means bolted to the brace of the securing means of Easy Fret.

FIG. 8 is a lateral perspective view of a leverage means that is fastened to brace (6) of the securing means of Easy Fret, said leverage means consisting of end sections (26) for holding the leverage means in place, at least one screw (20) for holding said end sections (26) in place, at least one screw (28) for holding pressure bar (32) in place, a leverage bar (24) for moving end C of leverage bar (25) upward, a leverage bar (25) for pressing on pressure panel (7) and moving bolt (17) downward, a fulcrum bar (29) for holding leverage bar (25), a fulcrum bar (27) for holding leverage bar (24), a fulcrum rod (23) for a fulcrum rest for leverage bar (24) a fulcrum bar (29) for a fulcrum rest for leverage bar (25), a base rod (22) for holding fulcrum bar (27) in place, a screw (31) for holding fulcrum bar (29) in place, an expanding joint (30) for holding the ends B and C of leverage bars (24) and (25) together, and a fulcrum rod (21) for a fulcrum rest for leverage bar (25).

Figure 9:
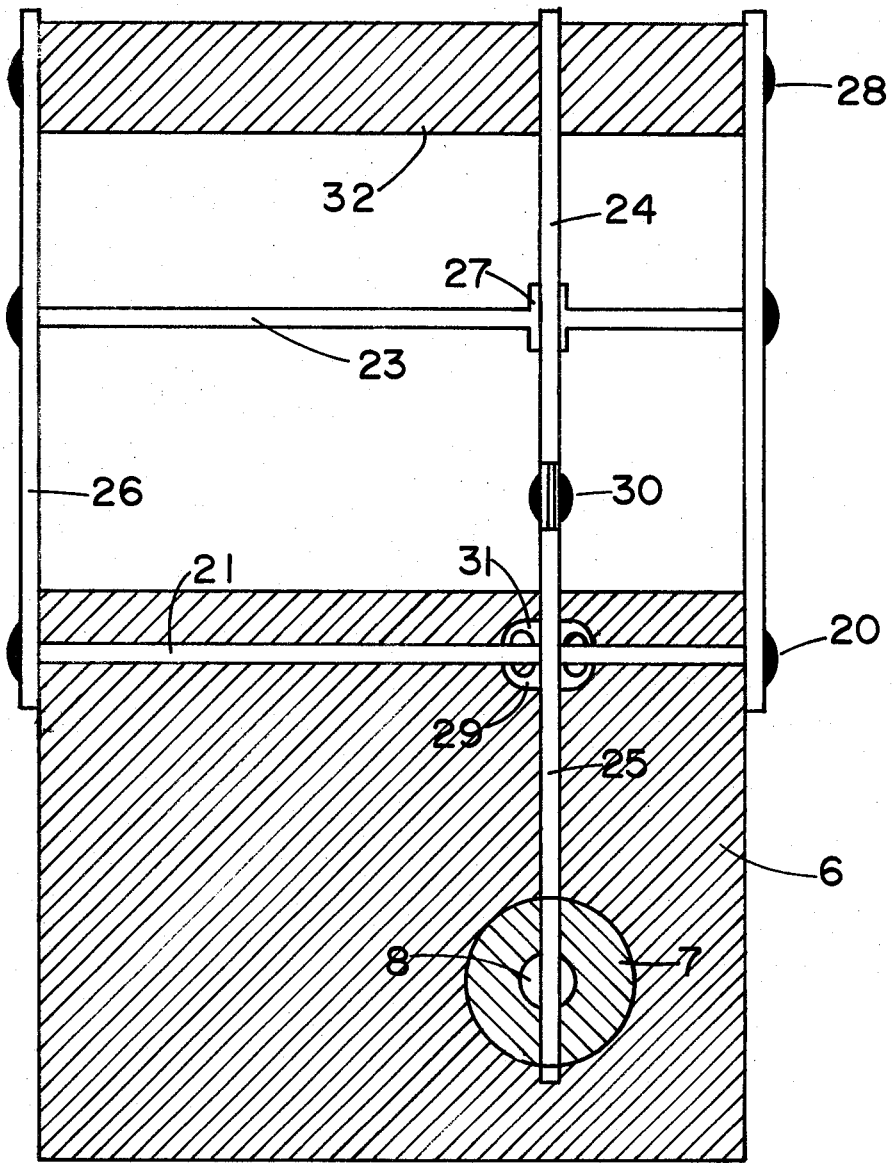
FIG. 9 is a partial perspective view of a leverage means bolted to the brace of the securing means of Easy Fret.

FIG. 9 is a partial perspective view of a leverage means secured to the securing means of Easy Fret, said leverage means consisting of end sections (26) for holding said leverage means in place, at least one screw (28) for holding pressure bar (32) in place, a pressure bar (32) for increasing leverage pressure to move end A of leverage bar (24) downward, a leverage bar (24) for moving end C of leverage bar (25) upward, a leverage bar (25) for pressing on pressure panel (7) thus moving bolt (17) downward, a fulcrum bar (27) for holding leverage bar (24) in place, a fulcrum rod (23) for a fulcrum rest for leverage bar (24), a fulcrum bar (29) for a fulcrum rest for leverage bar (25), a screw (31) for holding fulcrum bar (29) in place, an expanding joint (30) for holding ends B and C of leverage bars (24) and (25) together, and a fulcrum rod (21) for a fulcrum rest for leverage bar (25).

OPERATION

Refer to FIG. 1 for the operation of the securing means of Easy Fret. The guitar (FIG. 2;12) or the clamp (FIG. 1;2) is tilted to a vertical position for entering between the ends of said clamp (2) then returned to the horizontal position between the cleats (4) of the winged nuts (3) so that the edges of the said guitar (12) fit into the curved section of the cleats (4). After the clamp (2) is placed in the second fret space from the tuning bolt (9) of the said guitar (12), the winged nuts are turned in the swivels (5) simultaneously until the cleats (4) of the winged nuts (3) hold the said guitar (12) firmly.

A second clamp (2) is turned so that its edges enter vertically over the guitar (12) then turned horizontally and moved between the cleats (4) of the winged nuts (3) so that the edges of the said guitar (FIG. 2;12) fall inside the curved portion of the said cleats (4). This second clamp (4) is moved into the fourth fret space of the said guitar (FIG. 2;12), then the winged nuts (3) are turned in their swivels (5) simultaneously until the said cleats (4) of the said winged nuts (3) hold the said guitar firmly.

The brace (FIG. 3;6) must be drilled for two bolts (FIG. 3;17) so that there is a balanced tension for securing the plate (FIG. 3;15) and its extensions (FIG. 3;16) firmly in place over the strings (11) of the guitar (12). One end of the two bolts (17) must be secured to the pressure panel (7) with screws (8). Then two springs (13) are placed over the two bolts (17) so that tension is formed between the pressure panel (7) and the brace (6), said drilled holes being smaller than the said springs (13) when the said bolts (17) are entered into the said drilled holes of the said brace (6). Then the opposite ends of the two bolts (17) are secured to the plate (15) with screws (14), said plate (15) having been drilled to receive said screws (14).

Optionally, the brace (6) may be drilled for one bolt (FIG. 4;17*a*) only so that there is a balanced tension for securing the plate (FIG. 4;15) and its extensions (FIG. 4;16) firmly in place over the strings (11) of the guitar (12). One end of the one bolt (17*a*) must be secured to the pressure panel (7) with screw (8*a*). Then one spring (13*a*) is placed over the one bolt (17*a*) so that tension is formed between the pressure panel (7) and the brace (6), said drilled hole being smaller than said spring (13*a*) when the said bolt (17*a*) is entered into the said drilled hole of the brace (6). Then the opposite end of the said bolt (17*a*) is secured to the plate (15) with screw (14*a*), said plate (15) having been drilled to receive said screw (14*a*).

Easy Fret, having been manufactured and assembled into the brace (6) of the securing means, said brace (6) is placed upon the clamps (2) so that the screws (1) may be entered into their drilled receptacles in the brace (6) and said clamp (2), thus securing the chord selecting means for the making of chords (FIG. 5;16).

The brace (6) may be moved forward or backward by releasing the tension of the winged nuts (3) and from side to side by releasing one winged nut (3) and tightening the other.

Press down upon the pressure panel (7) for the making of chords (FIG. 5;16).

For operation of the note selecting means of Easy Fret the securing means must be assembled upon the neck of the guitar in the same way as for the chord selecting means described above.

The guitar (FIG. 2;12) or the clamp (FIG. 1;2) is tilted to a vertical position for entering between the ends of the said clamp (2) then returned to the horizontal position between the cleats (4) of the winged nuts (3) so that the edges of the said guitar (12) fit into the curved section of the cleats (4). After the clamp (2) is placed in the second fret space from the tuning bolt (9) of the said guitar (12), the winged nuts (3) are turned in the swivels (5) simultaneously until the cleats (4) of the said winged nuts (3) hold the said guitar (12) firmly.

A second clamp (2) is turned so that its edges enter vertically over the guitar (12) then turned horizontally and moved between the cleats (4) of the winged nuts (3) so that the edges of the said guitar (FIG. 2;12) fall inside the curved portion of the said cleats (4). This second clamp (4) is moved into the fourth fret space of the said guitar (FIG. 2;12), then the winged nuts (3) are turned in their swivels (5) simultaneously until the said cleats (4) of the said winged nuts (3) hold the said guitar firmly.

For the operation of the note selecting means as illustrated in FIGS. 6 and 7, the brace (6) must be drilled for at least eight bolts (17), having one bolt (17) for each note along the scale and having the first note repeated at the end of the scale.

The pressure panel (7) is secured to bolt (17) with a screw (8). Then a spring (13) is placed over the opposite end of bolt (17) and inserted into the drilled hole of the brace (6), said hole having been drilled in a location directly over the position of the note expected to be sounded by the extension (16). The plate extension (16) is secured by a screw (14) to the end of the bolt (17) which is opposite from the pressure panel (7).

The other seven bolts (17) must be assembled in like manner as number one so that they are held by the tension provided by the spring (13), said spring (13) holding tension between the pressure panel (7) and the brace (6) and preventing an accidental dampening of the string (11) of the guitar.

After the assembly of all of the pressure panels (7) to the plate extensions (16) with the screws (8) and (14) and with the bolt (17) for the complete set of notes along the musical scale, then the brace (6) is ready to be secured to the clamp (2) with screw (1).

Since all of the holes in the brace (6) have been drilled to correspond with specific note locations along the fretted neck of the guitar (12), the proper position of brace (6) may be made by moving it forward or backward after releasing the tension of the winged nuts (3) or by moving it from side to side by releasing one winged nut (3) and tightening the other.

Press down upon the pressure panel (7) and pluck the string (11) for the making of notes.

The pressure panel (7) may be pressed with the fingers of the instrumentalist, however, the leverage means that is set forth in this specification gives leverage and agility to the pressure that may be placed upon the pressure panel (7) because where there is leverage, a resistance may be moved faster and easier. It is the purpose of a lever to move a heavy load or to move a certain load more quickly.

The operation of the leverage means requires the instrumentalist to apply pressure upon pressure bar (32) in the opposite direction to simultaneous pressure upon the leverage bar (24) which moves the end A of leverage bar (24) downward because pressure bar (32) is stationary. When end A of leverage bar (24) moves downward, end B of leverage bar (24) moves upward. When end B of leverage bar (24) moves upward, this brings end C of leverage bar (25) up with it since the joint (30) is expandable. When end C of leverage bar (25) moves upward, end D of leverage bar (25) moves downward. The end D of leverage bar (25) is resting upon pressure panel (7), therefore, when end D of leverage bar (25) moves downward, it carries the bolt (17) down with it which forces extension (16) upon the string (11) of the guitar (12), thus a note is sounded if the string (11) is strummed.

When at least eight of the sets of these leverage bars (24) and (25) are assembled for pressure upon at least eight of these pressure panels (7), thus forming a complete set of notes in a musical scale on the strings (11) of a guitar (12), then a melody may be played by an instrumentalist operating the leverage means which is secured to the note selecting means of this invention.

Since numerous changes may be made in the above described construction and different embodiments of the invention may be made without departing from the spirit and scope thereof, it is intended that all of the matter contained in the foregoing description or shown in the accompanying drawings shall be interpreted as illustrative and not in a limiting sense.

What I claim and desire to secure by Letters Patent of the United States is as follows:

1. A manual, mechanical fretting device for fretted, stringed musical instruments, comprising:

a brace having a plurality of apertures formed therethrough;

means for adjustably clamping said brace to the neck of said stringed instrument, said clamping means holding said brace a fixed distance above the strings of said instruments;

a plurality of fretting means, each of said fretting means including a string deflecting element located below said brace and above said string, a pressure panel located above said brace, at least one bolt connecting said deflecting element and said pressure panel, said bolt passing through one of said apertures, and means for biasing said panel, bolt, and element upwardly away from said string; and leverage means for facilitating depression of said pressure panels, said leverage means comprising: a stationary frame fixedly connected to said brace, a pair of fulcrum bars fixed to said frame, a pressure bar fixed to the end of said frame remote from said brace, and a plurality of pairs of leverage bars, each of said pair of leverage bars having one leverage bar fulcrumed on one of said fulcrum bars and the other leverage bar fulcrumed on the other of said fulcrum bars, an expandable joint connecting the ends of said leverage bars between said fulcrum bars, the unjointed end of said one leverage bar being located above said pressure bar and the unjointed end of said other leverage bar being located above said pressure panel, whereby manual pressure on said unjointed end of said one leverage bar will cause the unjointed end of said other leverage bar to depress its associated pressure panel, thereby fretting the stringed instrument.

2. The fretting device of claim 1, wherein said string deflecting element has one string depressing extension thereon whereby only one string will be fretted to produce one note.

3. The fretting device of claim 1, wherein said string deflecting element has a plurality of string depressing extensions thereon whereby a plurality of strings will be depressed to produce a selected chord.

4. The fretting device of claim 1, wherein said clamping means includes at least one rigid clamping bar surrounding said neck and a plurality of manually operable screws threaded through said clamping bar, each of said screws having an L-shaped cleat journaled thereon for gripping the edge of said neck and fingerboard.

* * * * *